United States Patent [19]

Graham

[11] Patent Number: 4,892,224

[45] Date of Patent: Jan. 9, 1990

[54] SUPPORT DEVICE FOR A DISPOSABLE TRASH BAG

[76] Inventor: Donald J. Graham, 63 Driving Park Ave., Lynbrook, L.I., N.Y. 11563

[21] Appl. No.: 190,998

[22] Filed: May 6, 1988

[51] Int. Cl.[4] ..... B65D 90/04

[52] U.S. Cl. ..... 220/404; 220/1 T; 248/100

[58] Field of Search ..... 220/1 T, 403, 404; 232/43.2; 248/95, 97–101

[56] References Cited

U.S. PATENT DOCUMENTS

| | | | |
|---|---|---|---|
| 725,721 | 4/1903 | Kenney | 248/100 X |
| 914,057 | 3/1909 | Lyon | 248/100 x |
| 2,916,183 | 12/1959 | Ariens | 232/43.2 X |
| 3,191,798 | 6/1965 | White | 220/404 |
| 3,321,130 | 5/1967 | Cleghorn | 232/43.2 |
| 4,715,572 | 12/1987 | Robbins | 248/101 |
| 4,763,808 | 8/1988 | Guhl | 220/404 |

*Primary Examiner*—Robert G. Nilson

*Attorney, Agent, or Firm*—Roland T. Bryan

[57] ABSTRACT

A trash entry chute device for mounting on a top-opening trash container, which device supports and holds open a limp plastic film bag for use as a disposable liner for the container. The device comprises a chute having a flange which supports the device on the container and diverts trash into the chute, and bag support means in opposite positions on the outside surface of the chute. When a bag is supported by the device, the chute fits into the mouth of the bag, holding it open to receive trash.

1 Claim, 1 Drawing Sheet

SUPPORT DEVICE FOR A DISPOSABLE TRASH BAG

BACKGROUND OF THE INVENTION

This invention relates to a trash entry chute device which facilitates the use of standard grocery bags, such as limp plastic bags, as disposable liners in rigid top-opening waste or trash containers by supporting a bag in the container, holding the bag open to recieve trash or garbage, guiding trash or garbage into the bag, and preventing trash or garbage from falling between the bag and the container. Standard paper grocery bags may also be used to advantage as liners in containers equipped with the device of the invention.

For many years stores, particularly groceries, have provided relatively stff paper bags for their customers' purchases. These bags are often used as disposable liners in trash baskets and garbage cans. This practice has become so widespread that wastebaskets and garbage containers are now manufactured with dimensions which allow using standard grocery paper bags in this way.

Recently groceries, supermarkets and other stores have begun to use inexpensive thin plastic film bags such as the so-called t-shirt bag with handle loops described in U.S. Pat. No. 3,180,557 instead of the familiar brown paper bag. Because these bags are far more water-resistant than paper they are more useful for handling garbage and other wet trash, but they are too limp to stand up unsupported in a trash container. In order to use these and other limp plastic bags as liners, the top of the bag is pulled up over the top edge and down the outside of the container. If the bag fits the container well enough to allow this to be done, it may be rather unsightly and the bag being too short will then not be supported by the container bottom and may tear.

Many devices have been proposed to hold plastic bags open to allow filling them more easily for a variety of applications. U.S. Pat. No. 4,669,689 describes a device which is to be mounted on a vertical surface such as a wall or a door. It supports a plastic bag by its handle loops for use as a trash container. U.S. Pat. Nos. 4,530,553 and 4,659,045 describe collars for disposable trash bags which hold a bag open, but the devices will not support a bag in a container. U.S. Pat. No. 4,418,835 describes a trash container which has brackets bolted inside to support a plastic bag in the container by placing the handle loops of the bag over the brackets. No provision is made to keep carelessly discarded trash from falling between the bag and the container. U.S. Pat. No. 4,366,916 describes a container having upstanding ears on its top edge on which a plastic bag may be hung by its handles in an open position for easy loading. There is no provision to prevent items from falling between the bag and the container. U.S. Pat. No. 3,722,561 describes a sleeve device which fits inside a plastic bag to be used in a trash compactor. The device protects the bag from damage by the lateral crushing pressure of the compactor. The device extends the full depth of the bag and does not support the bag which is held in place between the walls of the device and the compactor housing by friction. None of the above inventions is suitable for the purposes of the present invention, and none provide all of its advantages.

SUMMARY OF THE INVENTION

This invention provides a trash entry chute device to be placed over the open mouth of a standard rigid top-opening trash or garbage container to facilitate the use of standard grocery bags, such as limp plastic bags as disposable liners for the container. The device compromises a smooth surfaced chute or funnel having a lip, collar, or flange around the opening or mouth at one end which serves to support the device on the mouth of the container and divert trash into the chute, a chute extending downwardly and inwardly from the collar for a distance so as to extend into the mouth of a standard grocery bag, the bottom of which rests on the bottom of the container, whereby the grocery bag is held open and facilitates the smooth entry of trash to be disposed into the grocery bag.

More specifically the invention provides at least two bag supporting means attached to or intergrally formed in opposed positions on the outside surface of the chute below the flange, and optionally, centering or locating means to position and hold the device in place on the mouth of the container. The device supports a limp plastic bag inside the container to serve as a disposable liner. Stiff paper bags may also be used as disposable liners in a container equipped with the device of the invention. The chute of the apparatus fits into the mouth of a plastic or paper bag, holds the bag open, guides trash or garbage from falling between the bag and the container, and keeps the top of the bag clean of debris permitting handling of the bag by clean handles or surfaces when it is to be disposed of.

DETAILED DESCRIPTION OF THE INVENTION

Most paper and plastic bags such as those used by groceries and other stores to pack their customer's purchases, are similary dimensioned and have essentially a rectangular cross-section at their bases. Therefore they are most practical as disposable liners for rectangular trash containers. A device employing a preferred form of the invention therefore will be dimensioned to use with standard household trash containers using standard bags having rectangular cross-sections. The drawings refer to an embodiment of the invention having a rectangular chute, but no limitation to rectangular shapes is intended thereby.

The trash entry chute of the invention is intended to enhance the operations of a standard household trash container. Such containers being dimensioned and arranged to be slightly larger, laterally and vertically, than the standard grocery bag. Then the standard trash container snuggly holds wholly the bag within it. The standard grocery bag has a vertical dimension so that the upper edge of the opening in the container is slightly above the upper edge of the standard grocery bag. In the present market place, paper and plastic bags are given out at the grocery store and each bag has about the same lateral and vertical dimensions so that the standard trash container snuggly and wholly holds the bag as shown in FIGS. 1 and 2, with the bottom of the bag resting on and supported by the bottom of the container.

Figure 1:
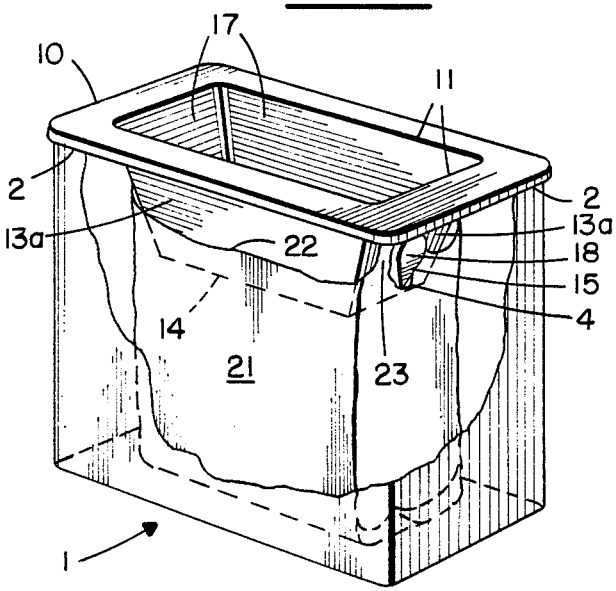
FIG. 1 is a perspective view of the trash entry chute on a standard rectangular trash container with portions of the container broken away to show the apparatus supporting a plastic bag by its handle loops and holding the mouth of the bag open for use as a disposable lining.
Figure 2:
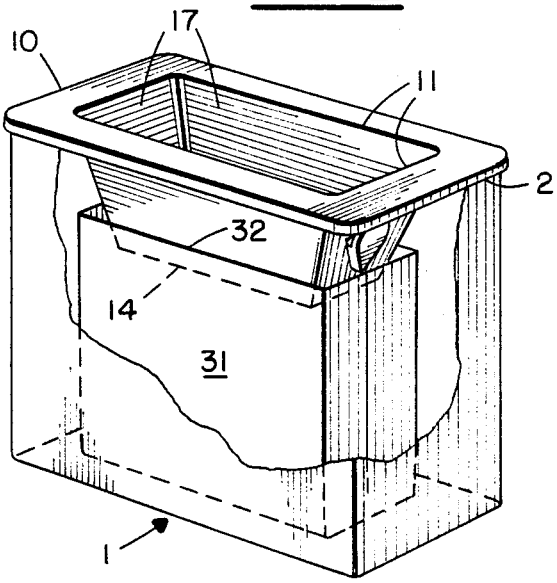
FIG. 2 is a similar perspective view of the trash entry chute of the invention on a standard trash container with portions of the container broken away to show the chute holding the mouth of a stiff bag open for use as a liner for the container.

Referring to FIGS. 1 and 2, the standard trash container 1 is shown with the trash entry chute of the invention inserted in the opening of the container. A flange 10 of the invention rests on and covers the top opening edge 2 of the container. Thus the flange functions as a seal around the top of the container so that anything discarded through the top of the chute will not fall down between the bag and the side of the container. The chute portion 17 extends downwardly from the flange 10 into the container and into the mouth of the standard trash bag which is shown in FIG. 1 as a plastic bag 21 and in FIG. 2 as a paper sack. The lower edge 14 of the chute is situated inside of and below the bag mouth defined by the upper edge 22 of the bag. In FIG. 1, the bag 21 is supported in the container by placing the bag handle 23 on the bag support 15 which is attached or integral to the outside wall 13*a* of the chute 17 so that the support 15 fits through the handle loop or hole 4 of the bag, supporting the bag. On the unseen opposite surface, the other handle of the bag is placed in a like fashion behind flange 19 on the bag support 16 (refer to FIG. 2).

Referring to FIG. 2, portions of trash container 1 are shown with the flange 10 of a device of the invention resting on and covering the top edge 2 of the container. This causes the flange to function as a seal around the top of the container so that anything discarded onto the top of the device will not fall down between the bag and the side of the container. The chute 17 extending downwardly into the container extends into the mouth of a paper bag 31 so that the lower edge 14 of the chute is situated inside of and below the bag mouth defined by the upper edge 32 of the bag. The paper bag resting on the bottom of the container inherently supports itself and will stay upright and open to receive the trash. The chute, by holding open the mouth of the paper bag, provides complete delivery and retention of the disposed trash.

Figure 3:
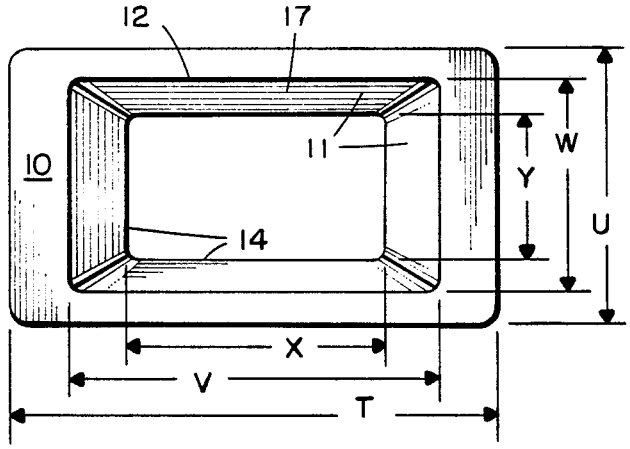
FIG. 3 is a plan view of an apparatus of the invention intended for use with a trash container having a rectangular horizontal cross-section.

Referring to FIG. 3, a chute 17 has a flange 10 attached to the edge 12 of the first opening or mouth 11 of the chute. The outside dimensions v and w of the mouth 11 of the chute are selected so that the mouth of the chute will be no larger than the mouth of the trash container to be used with the device. The outside dimensions t and u of the flange are selected to be at least as great as the corresponding dimensions of the outside edge of the mouth of the container. The dimensions x and y of the second opening or discharge end 14 of the chute are selected so that the discharge opening of the chute will be somewhat smaller than the mouth of the bags to be used as disposable liners for the container.

Figure 5:
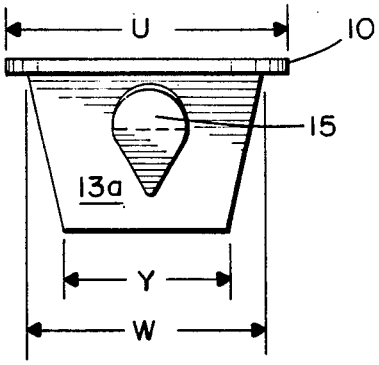
FIG. 5 is a side elevation of the apparatus shown in FIG. 1.
Figure 4:
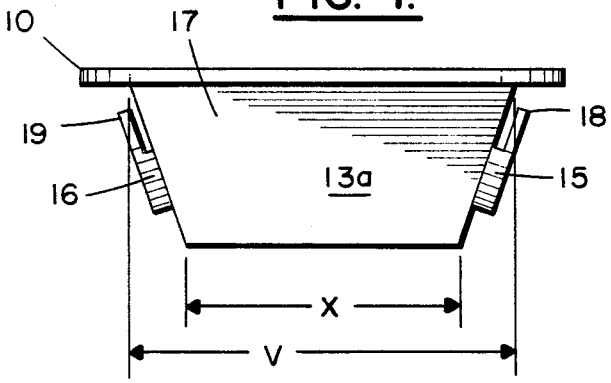
FIG. 4 is a front elevation of the apparatus shown in FIG. 1.

Referring now to FIGS. 4 and 5, bag support means 15 and 16 are attached to the outside surface 13*a* of the chute in opposite positions. Flanges 18 and 19 keep the bag handles from slipping off the support means. Values for the dimensions v and x of the chute are selected so that the support means 15 and 16 do not extend beyond a downward projection b of the mouth of the chute, thus allowing the device to fit freely inside the trash container it is to be used with.

The scope of the invention includes devices with chutes having various configurations, such as other polygonal, elliptical or even circular cross-sections and their mixtures. Devices with these shapes may be made for use with containers of similar of different cross-sections, so long as the containers are appropriately dimensioned to snuggly contain the size of the bags to be used, usually standard plastic or paper grocery bags.

The lip, collar, or flange of a device of the invention must support the device on the mouth of the container and form a seal with the edge of the mouth. Therefore, the flange must conform to the outline of the mouth of the container with which it is to be used, at least sufficiently to cover the edge of the mouth of the container to create a seal so that trash and liquids discarded onto the device will be directed first into the chute and then into the bag and not fall between the bag and the side of the container. It may be desirable to slant the top surface of the flange downward from the outside edge of the flange to the mouth of the chute to further assist in directing carelessly discarded trash into the chute. The flange of the chute may be shaped to extend beyond the top edge of the container, which affords a means to lift it easily from the container to dispose of the trash. It may also be made to curve downward over the side of the container for a short distance to form a lip which covers the joint between the top of the container and the device of the invention. The flange may also be shaped in a manner to afford finger holds or other means for grasping the device in order to lift it off the container and dispose of its contents. The junction of the flange with the chute may be faired to a smooth curve to assist the flow of debris. Although it would be possible to design a device to fit just inside the mouth of a container with means other than the flange to hold it in place, such a device would be less satisfactory than that of the invention because it would not cover the edge of the container mouth. Such a device would not form a seal and thus would not prevent liquids in trash or garbage thrown on top of the device form running down between the device and the side of the container, and collecting between the bag and the side of the container.

When the container is provided with a lid activated by a foot pedal or similar apparatus pushing a rod up the side of the container to lift the lid, a portion of the flange may be omitted to provide clearance for the pushrod mechanism. A lid for the container and device may be provided for by providing notches or other pivoting or hinging means on the flange to accept a lid. Provision may also be made for mounting a hood or other cover over the opening by fitting it on the surface of the flange or over the outside edge of the device, or the container. The flange may be altered to allow the addition of other accessories or equipment to the apparatus without departing from the scope of the invention.

The second or discharge end 14 of the chute 17 of a device of the invention will have a cross-section which allows it to fit within the mouth of the bags to be used as disposable liners for the container to allow the lower section or skirt at the discharge end of the chute to fit readily into the mouth of the bag, extending into the bag just sufficiently to hold the bag open and prevent trash from spilling over the top of the bag. Generally the cross-section of the skirt will be rectangular, but other geometric shapes which will fit in the mouth of a bag are within the scope of the invention. When a device of the invention has been designed with a rectangular chute for use with the usual or standard plastic or paper grocery bags, which are about the same size, the cross-section of the skirt of the chute will be less than about 7 inches by less than about 12 inches, the cross-section of standard bags. When other shaped cross-sections are used for the chute, the dimensions of the skirt will be selected to fit in the mouth of a bag. For example, if a circular cross-section is chosen for use with standard grocery bags, the lower opening or skirt must have a diameter of less than about 7 inches to fit in the mouth of the bag. Stated otherwise, the perimeter of the skirt of the chute is governed by the dimensions of the mouths of the bags with which it is to be used.

The length of the chute of a device of the invention will be great enough that when the device is in place on the mouth of a container the chute will extend into a bag supported by the device or placed in the container sufficiently to prevent trash from spilling over the top edge of the bag into the space between the bag and the side or bottom of the container. This will also keep the top of the bag and any handles clean and dry for ease of handling the bag when it is to be diposed of.

Since many bags, especially plastic grocery bags, are not rigid enough to stand up in a container, it is necessary to provide the apparatus of the invention with support means to hold up limp bags and hold them open around the discharge end of the chute. The plastic bags most commonly used are similar to the so-called t-shirt variety described in U.S. Pat. No. 3,180,557. These and other plastic bags generally are provided with two symmetrically placed handle loops or holes formed by varying means. These handle loops afford means to support the plastic bag and suspend it over the discharge end of the chute by placing the loops on support means attached or integrally formed at symmetrically spaced points on the outside surface of the chute. In the case of a chute with a rectangular cross-section, the supports will generally be placed on the two narrow sides of the chute, which corresponds to the location of most plastic bag handles. The support means are placed on the skirt far enough up toward the mouth of the chute to bring the mouth of a bag above the bottom of the skirt when the bag is hung from the support means. For the usual t-shirt bag the support means will be placed at least 6 inches above the bottom of the skirt. The support means may be any desired size and shape so long as they are small enough to pass through the handle loops or holes of a bag and afford a reasonably smooth, preferably curved surface for the handles of the bag to hang from without cutting or tearing under load. The support means should usually be notched or flanged, or otherwise provided with means to keep the bag handles from flipping off when they are placed on the support. Support means may be knobs or simple upward-pointing hooks, prongs or the like. In order to allow the use of limp plastic bags which do not have preformed handles, piercing or cutting means may be incorporated on the support means to allow piercing such bags to create openings.

The profile of the chute from the mouth to the discharge end is not generally critical, and may be selected for esthetic reasons or ease of manufacture. Size transitions should be kept gradual in order not to interfere with the flow of trash through the chute. Provisions must be made however that the chute is designed with sufficient clearance to allow room for the bag support means to fit inside the container the device is to be used with. This is done by shaping the chute so that the total distance between the bag support means is less than the width of the mouth of the chute. This is readily accomplished by tapering the chute from its mouth to the bottom of the skirt. Of course, if the container the device is to be used with has tapering vertical sides, the distance between the bag support means must be decreased to allow the device to fit into the container. It is possible to recess the bag supporting means in the outside surface of the chute, but generally this will require modification of the inside surface which could interfere with the flow of debris. Recessing the support means may also make it more difficult to keep the surfaces of the device clean. When the chute and bag supports dimensions and placement are selected so that the bag supports just touch the sides of the container, the bag supports will function as a locating and centering means for the device in the container.

The shape of the mouth of the chute at the supporting flange or lip is not critical and may be selected for esthetic reasons or ease of fabrication. In a preferred form of the invention the dimensions of the horizontal cross-section of the mouth of the chute are selected to fit rather snuggly into the mouth of the trash container it is to be used with. This allows the chute to serve as a centering or locating means for placing and holding the device on the container. Alternatively, if it is desired to use a chute mouth which is significantly smaller than the mouth of the container, other centering or locating means such as suitably placed pins, flanges, or other projections from the underside of the supporting flange may be used.

The apparatus of the invention may be fabricated from any suitable materials such as wood, sheet metal, rigid or semi-rigid plastics and the like, or combinations thereof. The only requirements are that the materials used have sufficient strength to support both the apparatus plus the bag of trash it supports, and that the materials are capable of being finished to a hard, smooth surface where the device comes into contact with trash so that it may be cleaned easily. Corners and creases which can trap dirt and filth and are difficult to clean should be avoided when designing a device of the invention. A particularly suitable apparatus may be manufactured by molding an impact-resistant plastic such as is used for forming trash containers.

While there are illustrated specific forms of the invention those skilled in the art will understand that changes may be made in the apparatus disclosed without departing from the spirit of the invention and that certain features of the invention may sometimes be used to advantage without a corresponding use of other features.

What is claimed is:

1. A trash entry chute device to be placed over the open mouth of a standard rigid top-opening trash container to facilitate the use of standard handled grocery bags, such as limp plastic bags, as disposable liners for the container, comprising a smooth surfaced chute having a collar around the mouth at one end which serves to support the device on the mouth of the container and divert trash into the chute, the chute arranged to extend downwardly and inwardly from the collar for a distance so as to extend into the mouth of a standard grocery bag, the bottom of which rests on the bottom of the container, whereby the grocery bag is held open and facilitates the smooth entry of trash to be disposed into the grocery bag, at least two bag supporting means attached to and in opposed positions on the outside surface of the chute below the flange and shaped to hold the bag by its handles whereby the limp plastic bag is supported inside the container while serving as a disposable liner.

* * * * *